US005823846A

United States Patent [19]

Arriola et al.

[11] Patent Number: 5,823,846

[45] Date of Patent: Oct. 20, 1998

[54] HOOP FOR EXERCISE AND ENTERTAINMENT HAVING DECORATIVE APPEARANCE

[75] Inventors: Martin F. Arriola, Torrance; Tichakorn Chaikumnerd, Huntington Beach; Janet K. Simmons, Redondo Beach; Diana L. McDonough, Chino; Isaak Volynsky, Beverly Hills, all of Calif.

[73] Assignee: Mattel, Inc., El Segundo, Calif.

[21] Appl. No.: 796,005

[22] Filed: Feb. 5, 1997

[51] Int. Cl.[6] ..... A63H 33/02

[52] U.S. Cl. ..... 446/236; 482/110

[58] Field of Search ..... 446/236, 219, 446/450, 452, 653, 46–48, 243; 482/110; 473/588, 589

[56] References Cited

U.S. PATENT DOCUMENTS

| | | | |
|---|---|---|---|
| D. 320,241 | 9/1991 | Moore . | |
| D. 359,994 | 7/1995 | Knopp . | |
| 3,815,313 | 6/1974 | Heisler . | |
| 3,918,708 | 11/1975 | Augusta . | |
| 4,254,869 | 3/1981 | Heier . | |
| 4,324,066 | 4/1982 | Smith et al. | 446/219 |
| 4,606,454 | 8/1986 | Hambleton et al. . | |
| 4,652,980 | 3/1987 | Segan . | |
| 4,890,829 | 1/1990 | Burton . | |
| 4,990,091 | 2/1991 | Mir-Heidari | 446/243 X |
| 5,088,611 | 2/1992 | Katz . | |
| 5,108,340 | 4/1992 | Farrow . | |
| 5,491,017 | 2/1996 | Todt . | |
| 5,538,454 | 7/1996 | Kessler | 446/236 |

*Primary Examiner*—Mickey Yu

[57] ABSTRACT

A circular hoop for use as an exercise and entertainment hoop includes a hollow tubular plastic body having a decorative layer supported thereon. The decorative layer in turn supports various decoration and patterns. The tubular body further includes a transparent or clear layer of plastic material or the like which captivates the decorative layer upon the tube and provides an abrasion resisting layer which protects the decorative patterns during use. An interior passage is formed within the hollow tube and a plurality of objects such as spherical balls are freely movable therein to provide additional amusement during operation of the exercise and entertainment hoop.

14 Claims, 2 Drawing Sheets

HOOP FOR EXERCISE AND ENTERTAINMENT HAVING DECORATIVE APPEARANCE

FIELD OF THE INVENTION

This invention relates generally to exercise and entertainment hoops and particularly to enhanced decoration and appearance features used thereon.

BACKGROUND OF THE INVENTION

Exercise and entertainment hoops have enjoyed great popularity among users of various ages for an extended period of time. Such exercise and entertainment hoops have proven to be popular with participants ranging from very young aged children to mature adults. In the most common activity participated in with such exercise and entertainment hoops, the user places the hoop about the waist or torso portion of the body encircling the user's torso and imparts a spinning or rotational motion to the hoop. Thereafter, the object is to gyrate and otherwise move the hips and torso in proper timed relationship to the rotation of the hoop against the user's body to maintain hoop motion. The undulations and gyrations which the user undertakes in this endeavor often generally resembles a Hawaiian hula dance and thus such exercise and entertainment hoops have become popularly known and referred to as "hula hoops".

While the basic exercise and entertainment hoop is a simple device typically formed of a plastic tube having the end portions curved together and joined to form a circular hoop, a variety of different enhancements have also been created. Thus, exercise and entertainment hoops have been provided in various colors and sizes. In addition, exercise and entertainment hoops have been provided which support light producing and/or sound producing elements often responsive to hoop movement or interaction on the user's body. In one variation, a decorative cloth outer covering sleeve is secured to the otherwise conventional exercise and entertainment hoop to enhance the appearance of the hoop.

Despite such variations, the great majority of exercise and entertainment hoops are formed using a hollow plastic tube fabricated by extruding plastic material. The hollow plastic tube is then curled bringing the ends together and a joining device such as an elongated cylindrical pin is forced between the hollow ends and joined thereto to complete the hoop fabrication. During the extrusion process, manufacturers often attempt to provide various colored spiral or straight line axial decorations to provide a more interesting and entertaining hoop. In addition, practitioners have attempted to enhance the appearance of the exercise and entertainment by covering the tube with a brightly colored elongated sheath of fabric tightly adhering to the tube.

While the various attempts by practitioners in the art to decorate or enhance the appearance of exercise and entertainment hoops has been somewhat appealing to consumers, problems often arise during use as the decorating materials or decorative outer sheath are damaged by abrasion against surrounding surfaces.

In response to the continued popularity of such exercise and entertainment hoops among consumers, practitioners continue to develop variations of the basic hoop. For example, U.S. Pat. No. 5,538,454 issued to Kessler sets forth DECORATION OF CHILDRENS PLAYTHINGS INCLUDING AN EXERCISE AND ENTERTAINMENT HOOP in which an otherwise conventional tubular hoop is provided with an elongated sheath of fabric tightly adhering to the outer surface. Various decorative patterns are imposed upon the fabric sheet.

U.S. Pat. No. 5,108,340 issued to Farrow sets forth a MUSICAL AND LIGHTED ENTERTAINMENT AND EXERCISE DEVICE having a circular hoop formed of a tubular material within which a variety of sensory appealing features such as light producing elements and music producing elements are supported. A plurality of actuating switches coupled to the light and sound producing elements are supported on the interior of the hoop.

U.S. Patent Des. 320,241 issued to Moore sets forth a LIGHTED HOOP having a tubular exercise and entertainment hoop defining a hollow passage therein which supports a plurality of light producing elements. A plurality of differently shaped light-transmissive apertures are formed in the tubular hoop.

U.S. Pat. No. 3,918,708 issued to Agusta sets forth an OPTICAL ILLUSION PRODUCING AMUSEMENT DEVICE having a resilient transparent tube formed in a circle. The tube interior supports a ribbon which is generally flat and is spirally wound within the tube interior.

U.S. Patent Des. 359,994 issued to Knopp sets forth a JUMBO HOOP having a tubular hoop formed in a circle and defining a substantially greater tube diameter than conventional exercise and entertainment hoops.

In arts generally related to the present invention, U.S. Pat. No. 4,890,829 issued to Burton sets forth a JUMPROPE or similar article which can also be formed into a hoop. The article is made of material that exhibits some stiffness and may include a core having a spirally wound overlay thereon treated to impart the necessary stiffness. The article has end portions that permit the joining of the ends to form a hoop.

U.S. Pat. No. 4,652,980 issued to Segan sets forth a MUSIC AND LIGHTS CHRISTMAS BALL ORNAMENT having a self-powered illuminated ornament decorated with an acetate shrink wrap covering a substantial portion of its surface.

In U.S. Pat. No. 3,815,313 issued to Heisler; U.S. Pat. No. 4,254,869 issued to Heier; and U.S. Pat. No. 5,491,017 issued to Todt, various shrink wrap packaging systems are shown. In a somewhat related technology, U.S. Pat. No. 4,606,454 issued to Hambelton, et al. and U.S. Pat. No. 5,088,611 issued to Katz, show systems for sealing containers using heat responsive or shrink wrap type materials.

While the above-described prior art exercise and entertainment hoops have to some extent improved the art and have in some instances enjoyed commercial success, there remains nonetheless a continuing need in the art for evermore improved and durable entertaining and amusing hoop devices.

SUMMARY OF THE INVENTION

Accordingly, it is a general object of the present invention to provide an improved exercise and entertainment hoop. It is a more particular object of the present invention to provide an improved exercise and entertainment device which supports highly decorative and amusing material on its outer surface. It is a still more particular object of the present invention to provide an improved exercise and entertainment hoop which while supporting entertaining and amusing decorative material also provides a highly durable and abrasion resistant outer surface.

In accordance with the present invention, there is provided an exercise and entertainment hoop comprising: an elongated member having joined ends forming a circular hoop; a light-transmissive protective outer layer enclosing the elongated member; and a decorative material interposed between the protective outer layer and the elongated member.

The present invention further provides an exercise and entertainment hoop comprising an elongated body forming a circle and having opposed ends joined to complete the circle, the body having: an extruded tube defining an outer surface; a decorative material layer supported upon the outer surface; and a light-transmissive protective outer layer enclosing the extruded tube and the decorative material layer captivating the decorative material layer against the outer surface, whereby the decorative material layer is visible through the light-transmissive protective outer layer.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
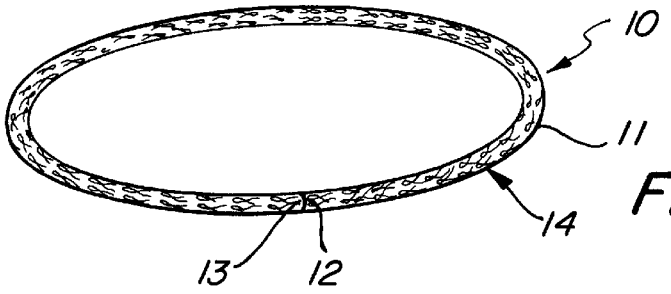
FIG. 1 sets forth a perspective view of an exercise and entertainment hoop constructed in accordance with the present invention.

FIG. 1 sets forth a perspective view of an exercise and entertainment hoop constructed in accordance with the present invention and generally referenced by numeral 10. Hoop 10 includes a cylindrical relatively rigid body 11 fabricated in the manner set forth below. Circular body 11 is, as described below, formed of an elongated tube and a plurality of covering layers having end portions 12 and 13 joined to form the circular hoop structure. As is also set forth below in greater detail, circular body 11 includes a plurality of covering layers including a decorative layer which supports a decoration 14 to enhance the appearance and attractiveness of the hoop. As is also described below and as is better seen in FIG. 2, hoop 10 includes a clear or transparent layer 35 which covers decoration 14. In accordance with an important aspect of the present invention, the transparent or clear covering of decoration 14 is protected by clear or transparent layer 35 to avoid damage to the decorative pattern and decoration through abrasive contact with surfaces such as the ground surface or the like.

Thus, hoop 10 may be utilized in accordance with virtually any play pattern utilizing such exercise and entertainment hoops such as the most common practice of rotating or spinning the hoop about the user's waist and torso. In addition, the provision of protective clear layer 35 (seen in FIG. 2) which overlies decoration 14 facilitates the use of hoop 10 in various other high abrasion uses such as rolling the hoop along the ground or the like. Unlike prior art devices in which the abrasion of surface contact by the hoop acts directly to damage the decorative pattern, the present invention hoop is protected. In accordance with the fabrication set forth below in greater detail, circular body 11 is preferably fabricated using a coextrusion process in which the tube body is extruded and a decorative layer or layers are applied together with a coextruded clear layer all of which are carried forward in an in-line or single path process. The tube may then be cut to appropriate length to form circular body 11 with the end portions thereof being joined in a convenient manner such as that shown in FIG. 3. It will be apparent to those skilled in the art that while the coextrusion process described below is believed advantageous and preferable in forming the various layers of the present invention hoop, other processes may be utilized to produce the present invention exercise and entertainment hoop.

Figure 2:
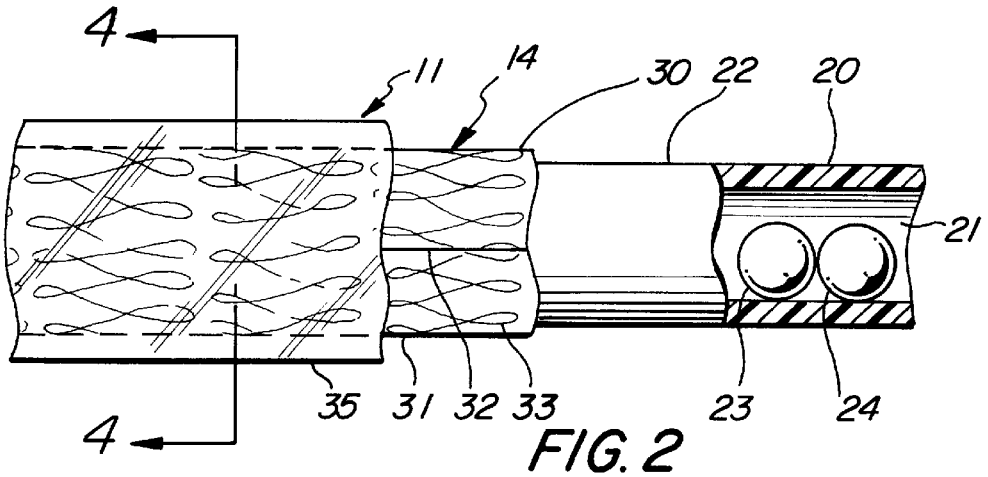
FIG. 2 sets forth a partial section view of a portion of the present invention exercise and entertainment hoop.

FIG. 2 sets forth a partial section view of circular body 11 showing the various layers and structural features thereof. A circular cross-section tube 20 preferably formed of an extruded plastic material or the like defines an interior passage 21 within which a plurality of movable objects such as balls 23 and 24 may be placed. The functions of balls 23 and 24 within interior passage 21 is directed toward producing additional sound and play pattern characteristics as the balls move within the interior passage during use. Tube 20 defines an outer surface 22 upon which a pair of decorative layers 30 and 31 are secured forming an overlap 32 therebetween. It will be apparent to those skilled in the art that while the use of decorative layers 30 and 31 to form decorative patterns upon outer surface 22 of tube 20 is, in many respects, the preferred fabrication of the present invention hoop, other processes such as painting or printing may be utilized in place of decorative layers 30 and 31. The use of such potentially fragile decorative systems such as decorative layers 30 and 31 as well as painted or printed patterns is facilitated by the use of a clear or transparent covering layer or sleeve 35. Clear layer 35 is preferably formed by the coextrusion process in the manner described below. However, the essential function of clear layer 35 may be accomplished using different apparatus or processes such as heat shrinkable wrapping material or tubing without departing from the spirit and scope of the present invention. However, the coextrusion process described below is believed to be the preferred manner of fabricating the present invention exercise and entertainment hoop and is believed to enjoy several advantages over alternatives. The essential feature of clear layer 35 is the provision of a clear or transparent layer which overlies decorative layers 30 and 31 while facilitating the observation of decorative patterns such as pattern 33 through the clear or transparent material.

Figure 3:
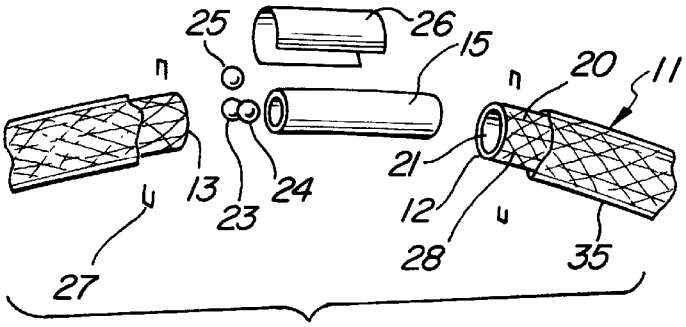
FIG. 3 sets forth a perspective assembly view of the connected end portions of the present invention exercise and entertainment hoop.

FIG. 3 sets forth a partial perspective assembly view of the end portions of the present invention exercise and entertainment hoop. Accordingly, body 11 having the various layers described above is formed into a circle bringing ends 12 and 13 into position in which a cylindrical plug 15 sized to be receivable within interior passage 21 may then be inserted into passage 21. Prior to assembly of ends 12 and 13 to plug 15, however, a plurality of objects such as balls 23 through 25 may be placed within passage 21 to perform as described above. Thereafter, with end portions 12 and 13 forced upon plug 15 and brought into contact, a plurality of conventional fasteners such as staples 27 are then driven through body 11 into plug 15 to secure ends 12 and 13 together. As a final step, a seam cover 26 is adhesively placed upon the resulting end seam to cover the end seam and staple insertions.

Figure 4:
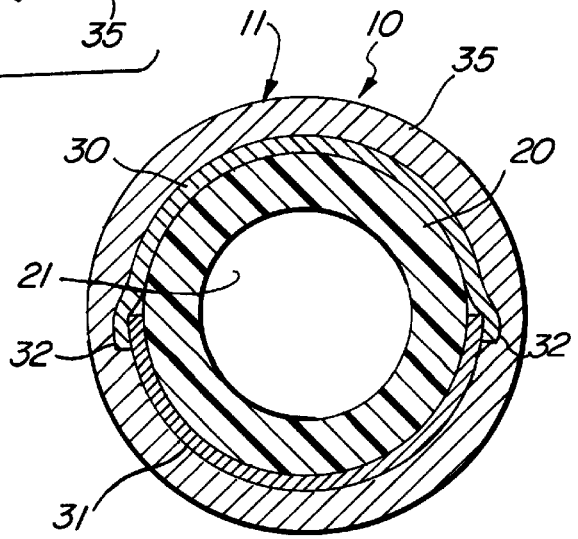
FIG. 4 sets forth a section view of the present invention exercise and entertainment hoop taken along section lines 4—4 in FIG. 2.

FIG. 3 also shows an alternate embodiment of the present invention exercise and entertainment hoop which differs from the exercise and entertainment hoop shown in FIGS. 1, 2 and 4 in that decorative layers 30 and 31 (seen in FIG. 2) are omitted and a decorative pattern 28 is applied directly to the outer surface of tube 20. As a result, clear or transparent layer 35 is applied directly to tube 20 to protect decorative pattern 28.

FIG. 4 sets forth a section view of exercise and entertainment hoop 10 taken along section lines 4—4 in FIG. 2. As described above, hoop 10 is fabricated of a circular body 11 having a hollow circular cross-section tube 20 defining an interior passage 21 upon which a pair of decorative layers 30 and 31 are placed. In further accordance with the present invention, a protective clear or transparent layer 35 is formed upon the combined structures of decorative layers 30 and 31 and tube 20 to captivate the decorative layers against the outer surface of tube 20. For purposes of convenience, decorative layers 30 and 31 are secured in an overlapping fashion forming overlaps 32 on each side of tube 20. The manufacturing process set forth below facilitates the captivation of layers 30 and 31 against the outer surface of tube 20 without the need for an adhesive attachment. However, in accordance with the selection of materials for decorative layers 30 and 31, it may be preferable to provide an adhesive material layer between tube 20 and layers 30 and 31. In either event, the entire combination is encased within clear or transparent layer 35.

Figure 5:
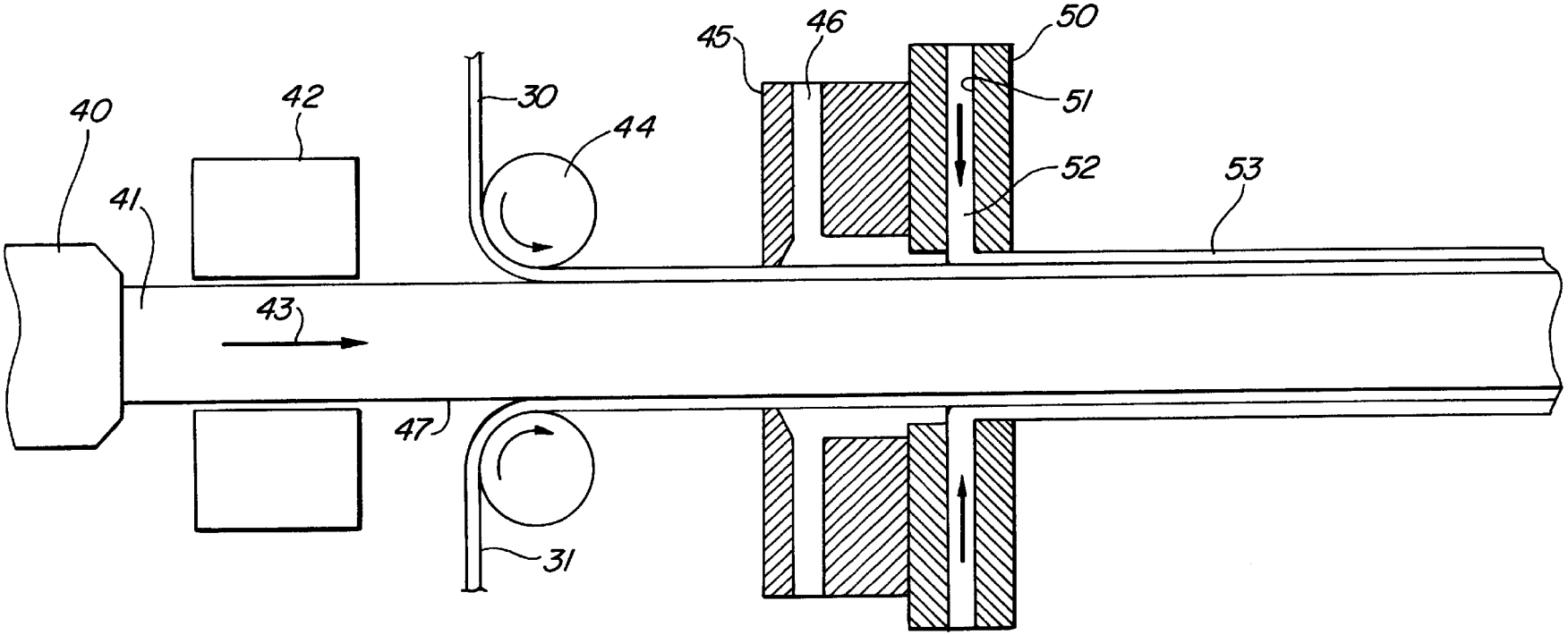
FIG. 5 sets forth a pictorial depiction of the fabrication process of the present invention exercise and entertainment hoop.

FIG. 5 sets forth a pictorial depiction of the preferred process for fabricating the present invention exercise and entertainment hoop. By way of overview, it will be apparent to those skilled in the art that the extrusion process which is utilized to form tube 41 as well as the coextrusion process of sleeve extruder 50 may be fabricated in accordance with well known extrusion techniques. Such extrusion systems may, for example, include extrusion equipment manufactured by RDN Manufacturing Company, Inc. and coextrusion apparatus manufactured by GENCA in Clearwater, Fla.

It will be understood by those skilled in the art that FIG. 5 is a pictorial representation of the fabrication process by which the present invention exercise and entertainment hoop is formed. It will be further recalled by those skilled in the art that, as mentioned above, while the process shown in FIG. 5 known in the art generally as "coextrusion" for forming outer layer 53 is preferred, other processes may be used in forming the present invention exercise and entertainment hoop. With specific reference to FIG. 5, a tube extruder 40 fabricated in accordance with conventional fabrication techniques forms a continuous hollow tube 41 using a conventional plastic material such as polypropylene or the like. As a result of the extruding process within extruder 40, a hollow plastic tube 41 is continuously formed and progresses in the downstream direction indicated by arrow 43. Tube 41 passes through a cooler stage 42 which, in accordance with conventional fabrication techniques, withdraws substantial heat from extruded tube 41 further solidifying the tube. Thereafter, tube 41 travels through a roller stage 44 in which a plurality of rollers positioned substantially encircling tube 41 receive and apply a pair of decorative layers 30 and 31 on opposite sides of tube 41. As is better seen above in FIG. 4, layers 30 and 31 each cover slightly more than half of the surface of tube 41 and thus form an overlap 32. While a variety of materials may be used for decorative layers 30 and 31, it has been found advantageous to use a material similar to that fabricating tube 41 such as polypropylene or the like to ease the application of decorative layers 30 and 31. As mentioned above, layers 30 and 31 may be applied without adhesive using the general affinity of similar plastic materials. However, an adhesive bond between layers 30 and 31 and the outer surface of tube 41 may also be provided. For example, decorative layers 30 and 31 may be provided having adhesive layers formed on the interior surfaces thereof which adhere to tube 41.

It should also be recalled that a decorative appearance may be imparted to tube 41 using alternative processes in which decorative layers 30 and 31 are not used, but rather, a direct coating or paint process is used to provide a decorative outer surface for tube 41. In either event, tube 41 then passes through a vacuum stage 45 and a sleeve extruder 50. Vacuum stage 45 and sleeve extruder 50 are fabricated in accordance with conventional fabrication techniques and provide the above-referenced "coextrusion" process by which an outer layer 53 formed of a clear or transparent plastic material such as polypropylene or the like is formed upon and encircles decorative layers 30 and 31 captivating layers 30 and 31 upon tube 41. Vacuum stage 45 utilizes a vacuum chamber 46 which is coupled to a source of vacuum (not shown). Vacuum chamber 46 functions to maintain a partial vacuum at the point of coextrusion of sleeve extruder 50 to avoid the formation of undesired air bubbles between outer layer 53 and decorative layers 30 and 31. Sleeve extruder 50 includes a molten material passage 51 within which a molten material 52 is supplied to the extruder die portion of extruder 50 to form the cylindrical outer layer of material which becomes outer layer 53 as tube 41 continues to move through extruder 50. Tube 41 having layers 30 and 31 as well as outer layer 53 supported thereon is then moved further downstream in the process and travels through additional rollers and cutting apparatus (not shown) such that tube 41 is continuously extruded and formed into the multilayer structure which is periodically cut to form body 11 (seen in FIG. 1) which may then be fabricated into exercise and entertainment hoops.

What has been shown is an exercise and entertainment hoop which provides a decorative and amusing appearance together with an abrasion resisting outer layer to increase the useful life of the exercise and entertainment hoop. The hoop is fabricated using a continuous coextrusion process or, alternatively, various other processes such as heat shrinkable tubing or the like. The resulting structure is relatively low cost and enjoys a substantial improvement in durability and long life.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An exercise and entertainment hoop comprising:

an elongated member having joined ends forming a circular hoop;

a light-transmissive protective outer layer enclosing said elongated member; and a decorative material interposed between said protective outer layer and said elongated member.

2. An exercise and entertainment hoop as set forth in claim 1 wherein said decorative material includes a paint deposited upon said elongated member to form a decoration.

3. An exercise and entertainment hoop as set forth in claim 2 wherein said elongated member is a circular cross-section tube.

4. An exercise and entertainment hoop as set forth in claim 3 wherein said circular cross-section tube is hollow.

5. An exercise and entertainment hoop as set forth in claim 4 further including a plurality of objects captivated within said circular cross-section tube.

6. An exercise and entertainment hoop as set forth in claim 1 wherein said decorative material includes at least one layer of material having a decoration thereon.

7. An exercise and entertainment hoop as set forth in claim 6 wherein said elongated member is a circular cross-section tube.

8. An exercise and entertainment hoop as set forth in claim 7 wherein said circular cross-section tube is hollow.

9. An exercise and entertainment hoop as set forth in claim 8 further including a plurality of objects captivated within said circular cross-section tube.

10. An exercise and entertainment hoop comprising an elongated body forming a circle and having opposed ends joined to complete said circle, said body having:

an extruded tube defining an outer surface;

a decorative material layer supported upon said outer surface; and a light-transmissive protective outer layer enclosing said extruded tube and said decorative material layer captivating said decorative material layer against said outer surface, whereby said decorative material layer is visible through said light-transmissive protective outer layer.

11. An exercise and entertainment hoop as set forth in claim 10 wherein said light-transmissive protective outer layer is transparent.

12. An exercise and entertainment hoop as set forth in claim 10 wherein said light-transmissive protective outer layer is clear.

13. An exercise and entertainment hoop as set forth in claim 10 wherein said decorative material layer includes a pair of overlapping elongated elements.

14. An exercise and entertainment hoop comprising:

an extruded tube defining opposed ends and an outer surface;

a layer of decorative material supported upon said outer surface; and a coextruded transparent protective layer formed upon said layer of decorative material, said opposed ends being joined to form a circular hoop.

* * * * *